United States Patent [19]

Molterer

[11] Patent Number: 5,027,953

[45] Date of Patent: Jul. 2, 1991

[54] PNEUMATIC PLANT-BLADE-FROM-STEM SEPARATOR

[76] Inventor: Anton W. Molterer, Rua Antonieta Revoredo, 126 - Sao Paulo, Brazil

[21] Appl. No.: 227,554

[22] Filed: Aug. 3, 1988

[30] Foreign Application Priority Data

May 2, 1988 [BR] Brazil ..... PI8802107

[51] Int. Cl.[5] ..... B07B 4/00

[52] U.S. Cl. ..... 209/133; 209/11; 209/138; 131/290

[58] Field of Search ..... 209/133, 136, 137, 138, 209/139.1, 154, 11; 131/290, 312

[56] References Cited

U.S. PATENT DOCUMENTS

| | | | |
|---|---|---|---|
| 149,869 | 4/1874 | Lacroix | 209/138 |
| 2,936,885 | 5/1960 | Hallworth | 209/138 X |
| 3,409,025 | 11/1968 | Wochnowski | 209/133 X |
| 3,542,037 | 11/1970 | Pietralunga | 209/137 X |
| 4,155,837 | 5/1979 | Trutzschler | 209/136 X |
| 4,233,159 | 11/1980 | Senda et al. | 22/413 |
| 4,253,940 | 3/1981 | Price | 209/3 |
| 4,287,064 | 9/1981 | Ando et al. | 210/413 |
| 4,465,194 | 8/1984 | Coleman | 209/639 |
| 4,701,256 | 10/1987 | Cross, Jr. | 209/139.1 |
| 4,915,824 | 4/1990 | Surtees | 209/139.1 |

FOREIGN PATENT DOCUMENTS

| | | | |
|---|---|---|---|
| 1172176 | 6/1964 | Fed. Rep. of Germany | 131/312 |
| 899163 | 1/1982 | U.S.S.R. | 209/137 |
| 413294 | 7/1934 | United Kingdom | 209/137 |

*Primary Examiner*—Donald T. Hajec

*Attorney, Agent, or Firm*—Parkhurst, Wendel & Rossi

[57] ABSTRACT

An improved pneumatic plant-blade-from-stem separator, including an upright box having an intermediate separating chamber with an inlet for material to be separated. Beneath the box an air inlet and an outlet mouth are provided, between which a discharge plane is disposed at an angle descending toward the outlet mouth. The plane is provided with a fixed bed comprising a plurality of longitudinally extending stock of square cross-sectional shape movable so as to define slots therebetween which are transverse to the bed.

2 Claims, 3 Drawing Sheets

PNEUMATIC PLANT-BLADE-FROM-STEM SEPARATOR

BACKGROUND OF THE INVENTION

This invention relates to a pneumatic plant-blade-from-stem separator, usable preferably in the processing of tobacco for cigarette manufacture.

As is known by those skilled in the art, in manufacturing cigarettes, a tobacco leaf today must have its stems removed, that is, the stem (petiole) separated from the blade (lamina). Leaf material, in a mixed state, is fed to a separating machine, from which the blades emerge at one side and the stems at the other.

Previously used processes for performing the above operation were unsatisfactory and, to provide a more efficient method therefor, the applicant has developed a machine and process to separate fragments of plant-material leaf blades (laminae) comminuted from the stem (petioles), which was the object of IP 8403264, in which some improvements were later introduced, as described in patent application IP 8704253, contemplating more enhanced operation thereof.

The machine covered by the above-mentioned patents is essentially comprised by an upright box arrangement, provided with a lower lateral air inlet emerging under a transverse and perforated conveyor mat, which was replaced by a tilted and transverse plate, provided with numerous holes. According to IP 8704253, the perforated plate is disposed at an angle, with the highest end over the air inlet and the lowest end adjoining an outlet for rejected stems.

Notwithstanding the good performance of this machine, it was found that, prior to the improvement described in IP 8704253, the stems became stuck in the holes of the mat and were carried to the underside thereof. The stems remained at the underside obstructing air circulation and, consequently, reduced the pneumatic transportation of blades to be separated, giving rise to the need for frequent cleaning of the lower chamber of the separator, as well as of the chains of the mat, with the latter mechanism further being subject to wear and tear.

Accordingly, for the purpose of overcoming such inconveniences, the improvements described in IP 8704253 were incorporated in the machine, namely, inclusion of a perforated and tilted plate in lieu of the conveyor mat. Thus, wear due to nonexistence of moving parts was eliminated enabling the machine to operate with less installed power, since a motor was no longer required for the mat.

Nevertheless, it was also found that, due to the round shape of the holes, some of the stems became lodged in the holes, to a point where the bed became obstructed. Furthermore, as the air is recirculated in this equipment with dust and small particles of blades being carried along, this material clung to the bottom of the perforated plate and was capable of totally or partially impeding pneumatic transportation of the blades being separated, which is a definite drawback from the standpoint of yields in the separating operation.

It should further be stressed that it would not be feasible to simply increase the diameter of the holes in the plate to prevent obstruction, since this would allow the stems to slip through, or these would clog the holes.

SUMMARY OF THE INVENTION

In view of these inconveniences and for the purpose of providing a solution for them, the improved pneumatic plant-blade-from-stem separator according to the present invention was devised. In such separator, the discharge of the unseparated product is conducted by means of laminar slots, forming flat and elongated interstices, with laminar jets covering the entire width of the separating chamber, mounted on a plane having a steep downward angle.

The thus improved separator presents the advantage of not allowing the bed to become obstructed, since stems possibly caught in the air slots are removed by the rolling action of the product itself being discharged, and are retained in an unstable manner, contrary to the plate having the round holes as described in IP 8704253, in which the stems become stuck because the stem diameter was the same as hole diameter.

A further advantage of the separator of the present invention is that it also does not allow the bed to become obstructed by circulation of airborne particles because the openings formed by the slots are bigger than such particles and allow for constant separation. The lower separator plenum is no longer required, since the bed is formed by lengthwise slots, crosswise to the separator, with a self-cleaning feature.

In addition to this, no wear is present due to the absence of moving parts; and less installed power is needed since a motor is not required to drive the mat, with the advantages obtained form the improvements discussed in IP 8704253 being thus maintained.

BRIEF DESCRIPTION OF THE DRAWINGS

The accompanying drawings illustrate the improved pneumatic plant-blade-from-stem separator according to the present invention, wherein.

DESCRIPTION OF THE PREFERRED EMBODIMENTS

Figure 1:
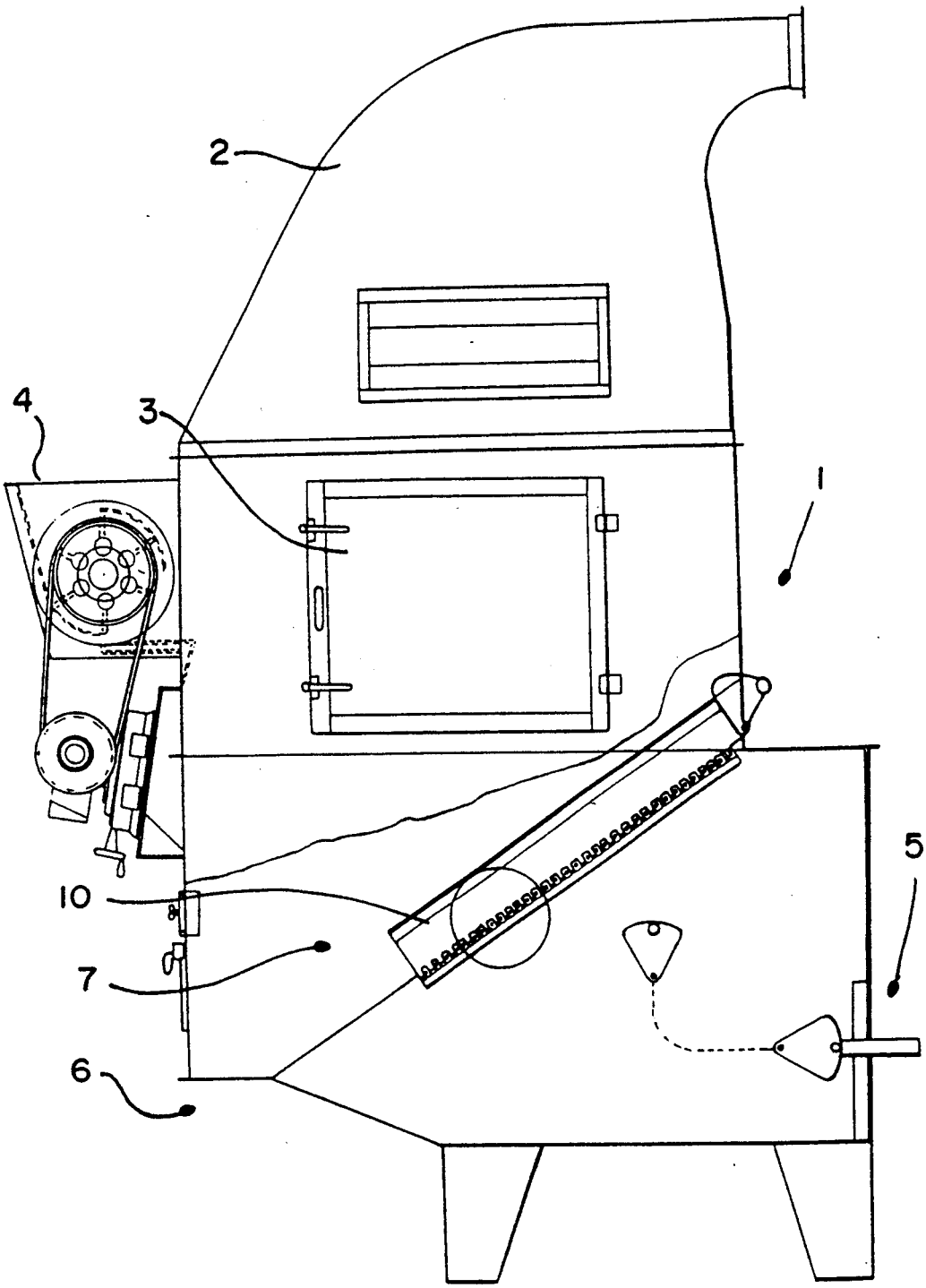
FIG. 1 is a side view thereof with a partial cross-section.

According to the aforementioned drawings, the improved pneumatic plant-blade-from-stem separator according to the present invention is comprised by an upright box 1, having an upper flue 2 and an intermediate separating chamber 3 with an inlet 4 for material to be separated. A heated air inlet 5 and a downward-facing outlet mouth 6 for the rejected stems are provided beneath the box 1, between which a discharge plane is disposed at an angle descending toward the outlet mouth 6 with the highest end being positioned above the hot air inlet 5.

Figure 2:
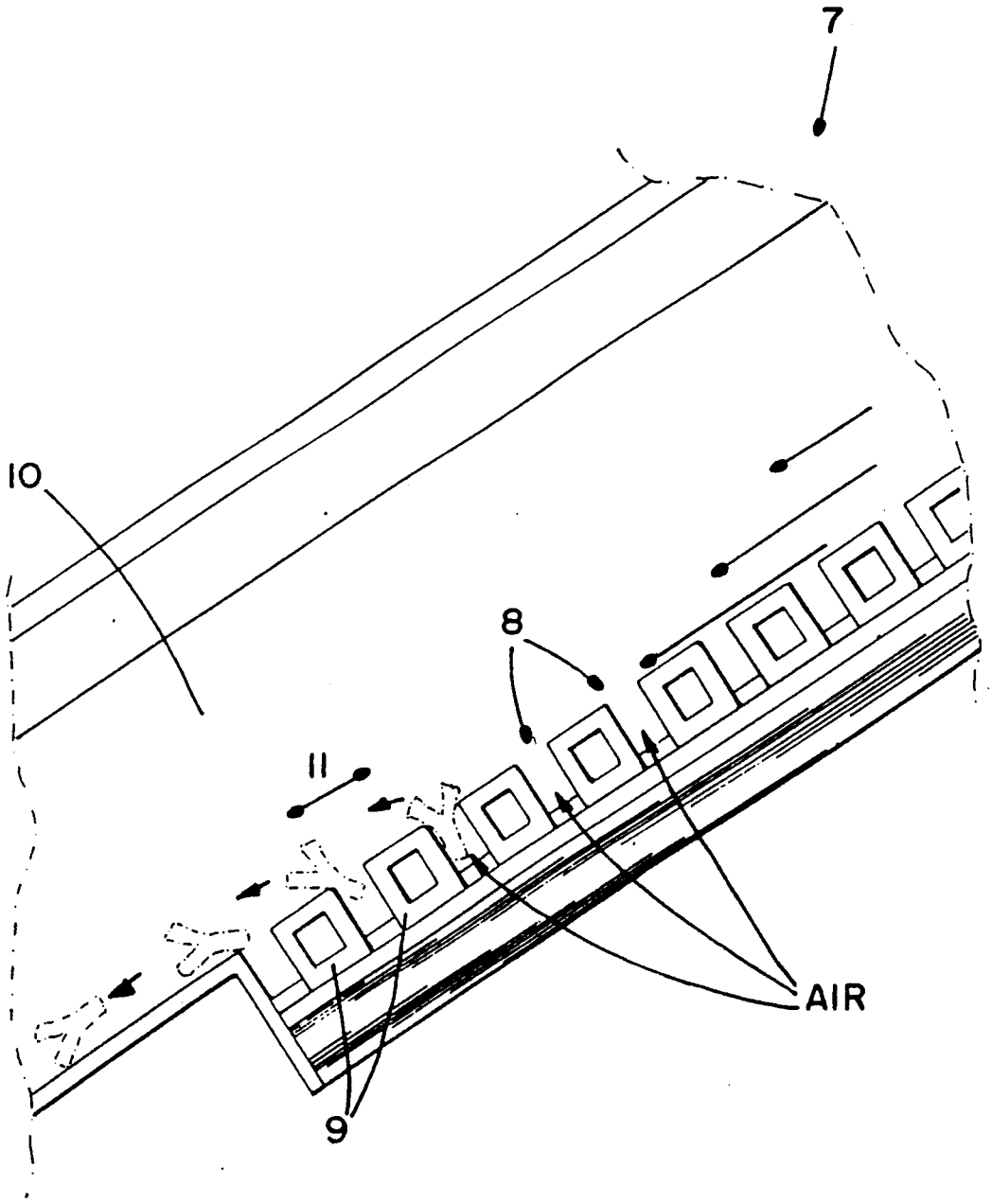
FIG. 2 illustrates a detail of how the stem is positioned in the slot.
Figure 3:
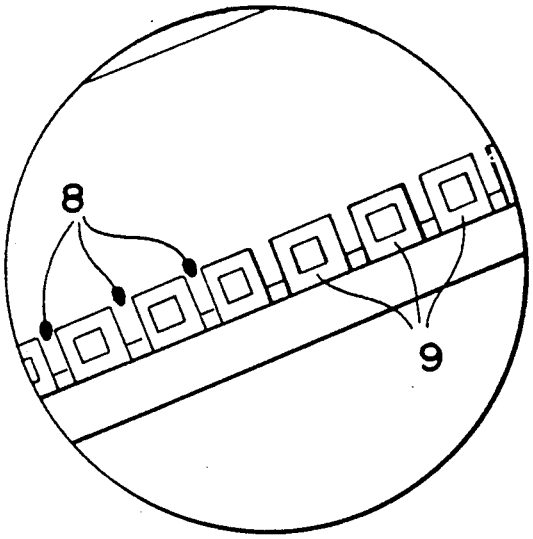
FIG. 3 illustrates an enlarged detail of FIG. 1.

The improved pneumatic separator according to the present invention is also provided with a fixed bed 7 comprising equally transverse lengths of square cross-sectional shaped stock 9, movable (in direction 11 depicted in FIG. 2) so as to define slots 8 therebetween which are laminar and transverse to the length of the bed 7 (the slots 8 and stock 9 shown also in FIG. 3). The lengths 9 are secured at their ends between fastener plates 10 integral with the inner sides of the box 1.

In the equipment thus comprised, the stem (which would have been withheld by the round hole, thus obstructing it) can drop into the slot (FIG. 2) but is easily removed by the flow of the material itself, being carried away because only two points hold it back. The powder and residues that circulate in a closed circuit pass easily through the slots, returning to circulation, and consequently, not clogging the passageways. In addition, the laminar slots increase the velocity of the air, improving the equipment's efficiency.

I claim:

1. A pneumatic plant-blade-from-stem separator, comprising:

an upright box having an intermediate separating chamber with an inlet chute and an upper flue;

a heated air inlet and downward facing outlet mouth disposed beneath said box;

a discharge plane disposed between said heated air inlet and said outlet mouth, said discharge plane having one end positioned above said heated air inlet and declining toward an other end at said outlet mouth, said discharge plane having a fixed bed positioned thereon comprising a plurality of longitudinally extending stock of square cross-sectional shape positioned so as to define slots therebetween which are transverse to the length of said bed, said slots between said stock being adjustable.

2. The pneumatic plant-blade-from stem separator of claim 1, further comprising fastener plates securing opposing ends of said plurality of stock therebetween, said fastener plates being positioned integral with inner side walls of said box.

* * * * *